US011359874B2

(12) United States Patent
Hsieh et al.

(10) Patent No.: US 11,359,874 B2
(45) Date of Patent: Jun. 14, 2022

(54) THREE DIMENSIONAL PULSATING HEAT PIPE

(71) Applicant: Industrial Technology Research Institute, Hsinchu (TW)

(72) Inventors: Cheng-Yuan Hsieh, New Taipei (TW); Chih-Yung Tseng, Yunlin County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 17/143,598

(22) Filed: Jan. 7, 2021

(65) Prior Publication Data

US 2022/0120520 A1 Apr. 21, 2022

(30) Foreign Application Priority Data

Oct. 19, 2020 (TW) ..... 109136120

(51) Int. Cl.
*F28F 13/10* (2006.01)
*F28D 15/02* (2006.01)

(52) U.S. Cl.
CPC ..... *F28F 13/10* (2013.01); *F28D 15/0266* (2013.01)

(58) Field of Classification Search
CPC ..... F28F 13/10; F28F 7/02; F28D 15/0266; F28D 15/0275; F28D 1/0472
USPC ..... 165/104.25
See application file for complete search history.

(56) References Cited

U.S. PATENT DOCUMENTS 5,845,702 A 12/1998 Dinh
6,315,033 B1 * 11/2001 Li ..... F28F 1/126 174/16.3
6,672,373 B2 1/2004 Smyrnov
6,808,013 B2 * 10/2004 Lai ..... H01L 23/427 165/80.4
7,515,417 B2 * 4/2009 Lee ..... F28D 15/0275 165/80.4
10,782,079 B2 * 9/2020 Tseng ..... F28D 15/0266
(Continued)

FOREIGN PATENT DOCUMENTS

CN 2636418 Y 8/2004
CN 1632441 A 6/2005
(Continued)

OTHER PUBLICATIONS

Vries et al. "Design and operation of a Tesla-typevalve for pulsating heat pipes", International Journal of Heat and Mass Transfer 105 (2017) 1-11.
(Continued)

*Primary Examiner* — Jon T. Schermerhorn, Jr.
(74) *Attorney, Agent, or Firm* — WPAT, PC

(57) ABSTRACT

A three dimensional pulsating heat pipe includes a three dimensional pipe coil structure and a heat exchange chamber. The three dimensional pipe coil structure is formed by winding at least one metal pipe to surround repeatedly a central axis and stack by extending along the central axis. Two opposite sides of the three dimensional pipe coil structure are arranged as a heating section and a condensation section, respectively. The heat exchange chamber is disposed at the heating section. Two opposite ends of the at least one metal pipe are connected with an interior of the heat exchange chamber.

17 Claims, 12 Drawing Sheets

(56) References Cited

U.S. PATENT DOCUMENTS

| | | | | |
|---|---|---|---|---|
| 2005/0022977 | A1 | 2/2005 | Kohara et al. | |
| 2006/0180297 | A1* | 8/2006 | Peng | F28D 15/0275 165/104.33 |
| 2010/0242502 | A1 | 9/2010 | Stautner | |
| 2011/0067843 | A1 | 3/2011 | Vasiliev, Jr. | |
| 2018/0010860 | A1* | 1/2018 | Tseng | F28D 15/0266 |
| 2020/0088479 | A1* | 3/2020 | Tseng | F28D 15/0275 |

FOREIGN PATENT DOCUMENTS

| | | | |
|---|---|---|---|
| CN | 101424491 | A | 5/2009 |
| CN | 201803624 | U | 4/2011 |
| CN | 101776408 | B | 8/2011 |
| CN | 102620586 | A | 8/2012 |
| CN | 102620587 | A | 8/2012 |
| CN | 102628655 | B | 4/2013 |
| CN | 203083412 | U | 7/2013 |
| CN | 103307917 | B | 9/2015 |
| CN | 105222628 | A | 1/2016 |
| CN | 104422319 | B | 8/2016 |
| CN | 105091643 | B | 5/2017 |
| CN | 106895728 | A | 6/2017 |
| CN | 107588671 | A | 1/2018 |
| TW | I270648 | | 1/2007 |
| TW | I307756 | | 3/2009 |
| TW | 201105225 | A1 | 2/2011 |
| TW | 201116793 | A | 5/2011 |
| TW | I387718 | | 3/2013 |
| TW | M470497 | | 1/2014 |
| TW | I493150 | | 7/2015 |
| TW | I542276 | | 7/2016 |
| TW | I579519 | | 4/2017 |
| TW | I580921 | | 5/2017 |
| TW | 201802425 | A | 1/2018 |
| TW | I685638 | | 2/2020 |
| TW | 202010993 | A | 3/2020 |

OTHER PUBLICATIONS

Lin et al. "Experimental investigation of a dualcompensation chamber loop heat pipe", International Journal of Heat and Mass Transfer 53 (2010) 3231-3240.

Konev S.V. et al. "Experimental modeling of pulsating heat pipes", Sep. 8-11, 2003, V Minsk International Seminar "Heat Pipes, Heat Pumps, Refrigerators".

Wan et al. "Heat transfer performances of thecapillary loop pulsating heat pipes withspring-loaded check valve", Applied Thermal Engineering 167(2020) 114803.

Khandekar et al. "Multiple quasi-steady states in a closed loop pulsating heat pipe", International Journal of Thermal Science 48 (2009) 535-546.

Zhao et al. "Thermal performance investigation of anoscillating heat pipe with externalexpansion structure used for thermalenergy recovery and storage", International Journal of Heat and Mass Transfer 132 (2019) 920-928.

TW OA dated Apr. 25, 2022.

* cited by examiner

THREE DIMENSIONAL PULSATING HEAT PIPE

CROSS REFERENCE TO RELATED APPLICATION

This application claims the benefits of Taiwan application Serial No. 109136120, filed Oct. 19, 2020, the disclosures of which are incorporated by references herein in its entirety.

TECHNICAL FIELD

The present disclosure relates in general to a three dimensional pulsating heat pipe.

BACKGROUND

In the art, the pulsating heat pipe is mainly structured as a serpentine piping system by bending slender pipes with capillary-grade size. The working fluid in the pulsating heat pipe is naturally formed by surface tensions into sectional liquid plungers, separated by air or vapor plungers. In the heating section of the heat pipe, the liquid membranes of the liquid plungers or vapor plungers on the pipe wall would be heated and evaporated so as to expand the corresponding vapor plungers, and to further push the vapor and the liquid plungers to move toward the condensation section of the heat pipe. In the condensation section, the vapors of the working liquid would be condensed, and thus the corresponding volume would be significantly shrunk. Since the dimensions and distributions of the vapor or liquid plungers in the heat pipe are random, thus pressure differences would be generated in the heat pipe. Thereupon, remarkable pulsating motions of the working fluid inside the heat pipe would be induced to promote efficiently the heat transfer.

Nevertheless, in producing a conventional pulsating heat pipe, in the case that the curvature radius of the bent section of the pipes is too small, the bent pipes would be vulnerable to excessive deformations or raptures. Thus, the manufacturing of the conventional pulsating heat pipe does meet a difficulty in bending the pipes and a limitation at the curvature radius of the bent section. Hence, preset spacing between pipes is inevitable. However, due to the spacing between pipes, heat transfer across the pipes would be adversely influenced, and thus the heat transfer per unit projection area ($W/cm^2$) would be reduced. Since plenty problems may be met in designing and manufacturing the conventional pulsating heat pipe, and also specific bending fixtures are required, thus the manufacturing cost is hard to be reduced.

With the development of science and technology, the performance of electronic parts is getting better and better, but the volume is getting smaller and smaller. In addition, since the power density continues to increase, the required heat dissipation capacity per unit area is also increasing. Therefore, for high-power electronic devices, such as laser projectors, computers and network switches, the demands in higher heat dissipation capacity is urgent. Therefore, increasing the heat dissipation per unit area of heat exchange components becomes a trend.

Therefore, how to improve the problems encountered above will be one of the issues that the industry must solve.

SUMMARY

An object of the present disclosure is to provide a three dimensional pulsating heat pipe that is furnished with a heat exchange chamber for enhancing heat transfer and heat exchange capacity per unit area of the entire three dimensional pulsating heat pipe, and so that the angling of the heat pipe won't become a concern.

In one embodiment of this disclosure, a three dimensional pulsating heat pipe includes a three dimensional pipe coil structure and a heat exchange chamber. The three dimensional circular pipe structure is formed by winding at least one metal pipe to surround repeatedly a central axis and stack by extending along the central axis. Two opposite sides of the three dimensional pipe coil structure are arranged as a heating section and a condensation section, respectively. The heat exchange chamber is disposed at the heating section. Two opposite ends of the at least one metal pipe are connected with an interior of the heat exchange chamber.

As stated above, in the three dimensional pulsating heat pipe provided in this disclosure, the heat section of the three dimensional circular pipe structure is contacted with the heat exchange chamber, and the heat exchange chamber is further connected with the opposing ends of the metal pipes forming the three dimensional pipe coil structure, such that the heat exchange chamber and the three dimensional pipe coil structure are integrated to form a single close loop. In comparison with the conventional design who provides only the heating section of the metal pipes to form the heat exchange area, the heat exchange chamber of this disclosure can provide more working fluid to be heated at the heating section. Namely, though the heating area of the heating section might be the same, yet the three dimensional pulsating heat pipe furnished with the heat exchange chamber according to this disclosure can be superior in providing the entire heat transfer and heat exchange capacity per unit area.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
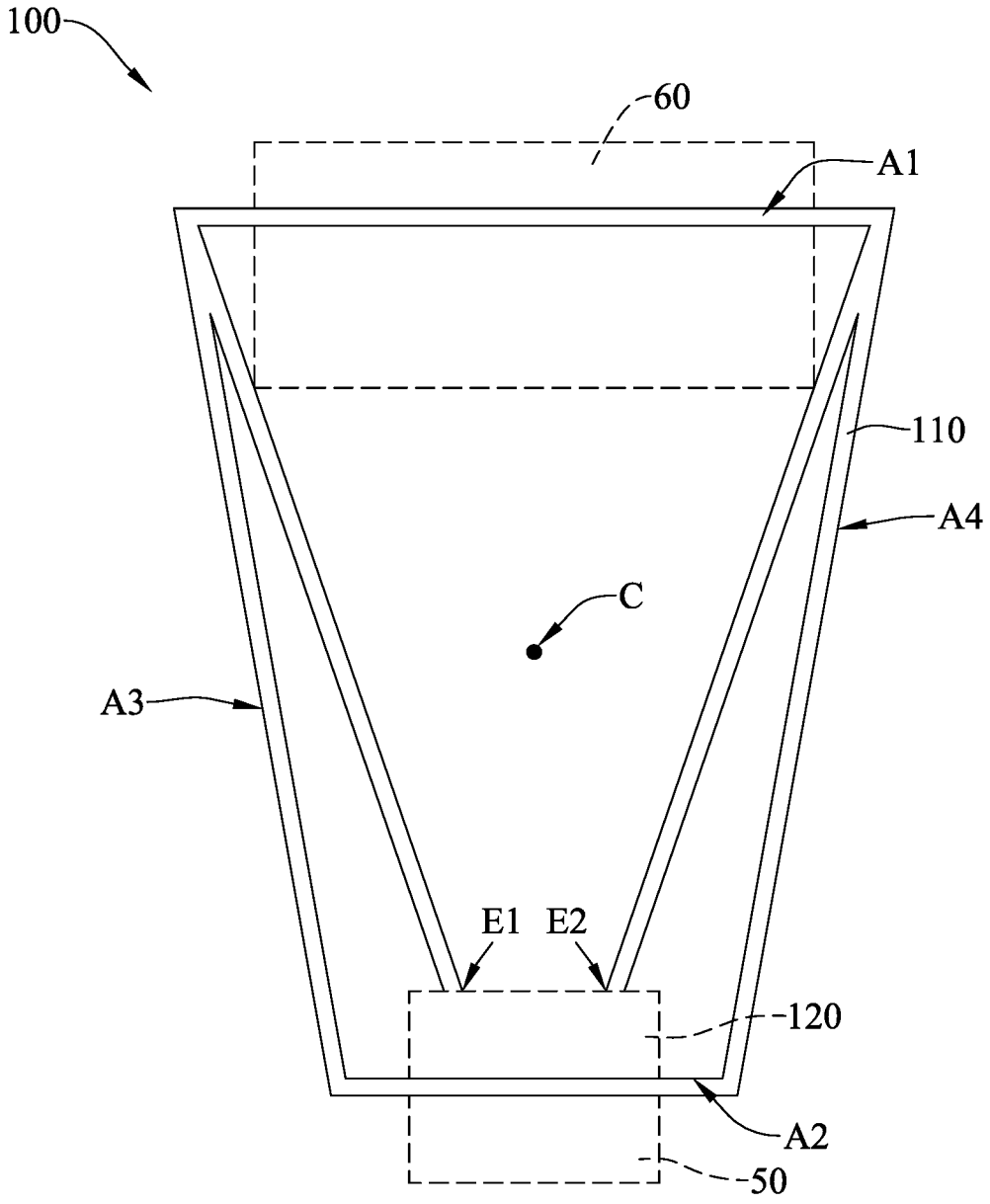
FIG. 1 is a schematic view of an embodiment of the three dimensional pulsating heat pipe in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring to FIG. 1, a schematic view of an embodiment of the three dimensional pulsating heat pipe in accordance with this disclosure is shown. In this embodiment, the three dimensional pulsating heat pipe 100 includes a three dimensional pipe coil structure 110 and a heat exchange chamber 120. The three dimensional pipe coil structure 110 includes heat pipes with a pulsating function, and is roughly shaped as a trapezoid. In some other embodiments, the three dimensional pipe coil structure 110 can be shaped to be rectangular or triangular. Two opposite sides (corresponding to upper and lower ends in FIG. 1) of the three dimensional pipe coil structure 110 are individually arranged as a condensation section A1 and a heating section A2, where lengths of the heating section A2 and the condensation section A1 are different. However, in some other embodiments, the heating section A2 and the condensation section A1 may have the same length. As shown in FIG. 1, the condensation section A1 is connected with a heat sink 60, and the heating section A2 is connected with a heat source 50. In the three dimensional pipe coil structure 110, a horizontal height (altitude) of the heating section A2 is lower than that of the condensation section A1. Namely, the correct installation of the three dimensional pulsating heat pipe 100 is to have the heating section A2 to be located under the condensation section A1. Thereupon, the working fluid which can have an assist from gravity facilitates the heated and expanding vapor plungers to push the liquid plungers, as well as the vapor plungers, to flow upward and toward the condensation section A1 located above the heating section A2, such that one side of the work-fluid circulation inside the heat pipe can be easily established. However, it shall be understood that the circulating pattern inside the three dimensional pulsating heat pipe 100 of this embodiment is not limited to the aforesaid circulating pattern. In FIG. 9 through FIG. 12, different circulating patterns for the pulsating heat pipe are schematically demonstrated. Of course, beside those shown in FIG. 1, FIG. 9 to FIG. 12, the winding of the three dimensional circular pipe structure 110 and the arrangement of the heat exchange chamber 120 can be adjusted according to practical requirements.

Figure 5:
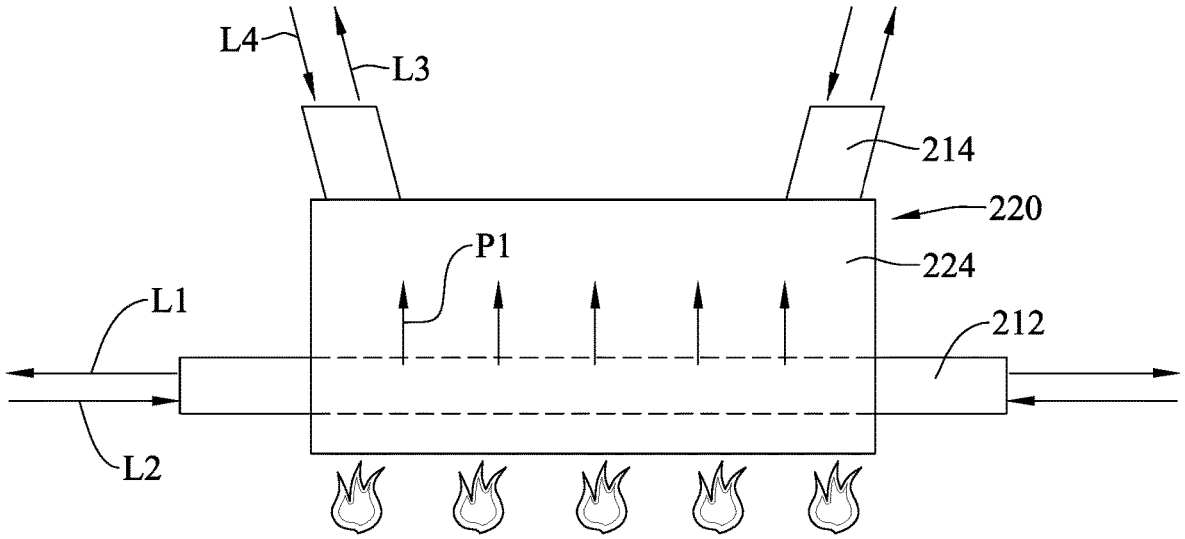
FIG. 5 is a schematic view of another example of the heat exchange chamber and the connected metal pipes in accordance with this disclosure.

In this embodiment, the three dimensional pipe coil structure 110 has two adiabatic sections A3, A4 located between the condensation section A1 and the heating section A2. The heat source 50 can be a high-power lamp, a laser projector, a computer, a network switch, a server, a 5G (5th generation mobile networks or 5th generation wireless systems) cell site, an insulated gate bipolar transistor (IGBT) or any electronic part or device that is driven by a high power. The heat sink 60 can be a heat-dissipation module. The heat exchange chamber 120 is disposed at the heating section A2. Each metal pipe for forming the three dimensional pipe coil structure 110 is bent continuously to surround repeatedly the central axis C, and is thus divided into a middle pipe portion and two opposite end portions (leading to form individually a first end E1 and a second end E2). The middle pipe portion is named as the metal pipe 212, while any of the two end portions is named as the metal pipe 214. As shown in FIG. 5, the metal pipes 214 of the three dimensional circular pipe structure 110 are extended to connect with an interior of the heat exchange chamber 120 via the first ends E1 or the second ends E2.

Upon such an arrangement of this embodiment, the heating section A2 of the three dimensional pipe coil structure 110 is connected with the heat exchange chamber 120 by connecting the first end E1 and the second end E2 of each metal pipe of the three dimensional pipe coil structure 110, such that the heat exchange chamber 120 and the three dimensional pipe coil structure 110 can be integrated to form a single close loop for the working fluid. As such, beside the entire heat exchange area of the metal pipes at the heating section A2 can be increased, the heat exchange chamber 120 would heat up more working fluid at the heating section A2. Namely, even provided with the same heating area at the heating section A2, the entire heat transfer and heat exchange capacity per unit area of the three dimensional pulsating heat pipe 100 can be promoted by allowing more working fluid to flow through the heat exchange chamber 120.

In a testing, Example 1 is a control group having a three dimensional pulsating heat pipe equipped with no heat exchange chamber, while Example 2 is a test group having a three dimensional pulsating heat pipe equipped with the heat exchange chamber 120 in accordance with this disclosure. The test results are listed in Table 1 as follows.

TABLE 1

| | Example 1 | Example 2 |
|---|---|---|
| Volume filling percentage | 35% ± 5% | 35% ± 5% |
| Maximum heating wattage | 900 W | 1400 W |
| Evaporation area | 72 $cm^2$ (including only areas of the metal pipes) | 150 $cm^2$ |
| Heat flux | 25 $W/cm^2$ | 38.8 $W/cm^2$ |

In Table 1, the maximum heating wattage is defined to be the maximum wattage that can be reached at a 100° C. evaporation temperature. From Table 1, it is observed that the evaporation area of Example 2 is 1.1 times more than that of Example 1, and the heat flux of Example 2 is 55% more than that of Example 1. It is proved that, with the heat exchange chamber 120 to connect the heating section A2 in Example 2, the entire heat transfer and heat exchange capacity per unit area of the three dimensional pulsating heat pipe 100 can be significantly increased by including the heat exchange chamber 120. In addition, though not shown in Table 1, the heat resistance of Example 2 is remarkably reduced to 0.0426 K/W for an upright mounting, and 0.0701 K/W for a negative angular mounting.

Figure 2:
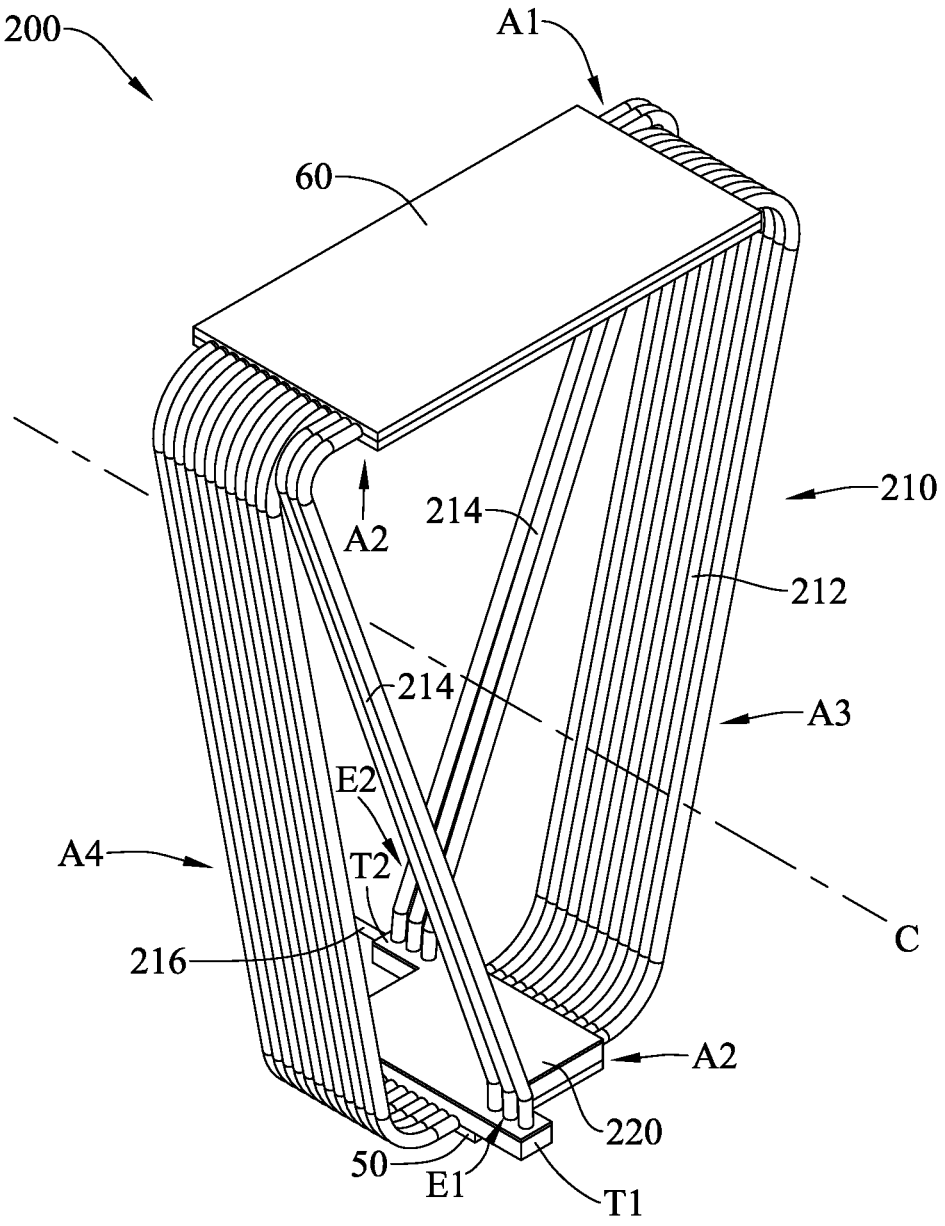
FIG. 2 is a schematic perspective of an exemplary embodiment of FIG. 1.
Figure 3:
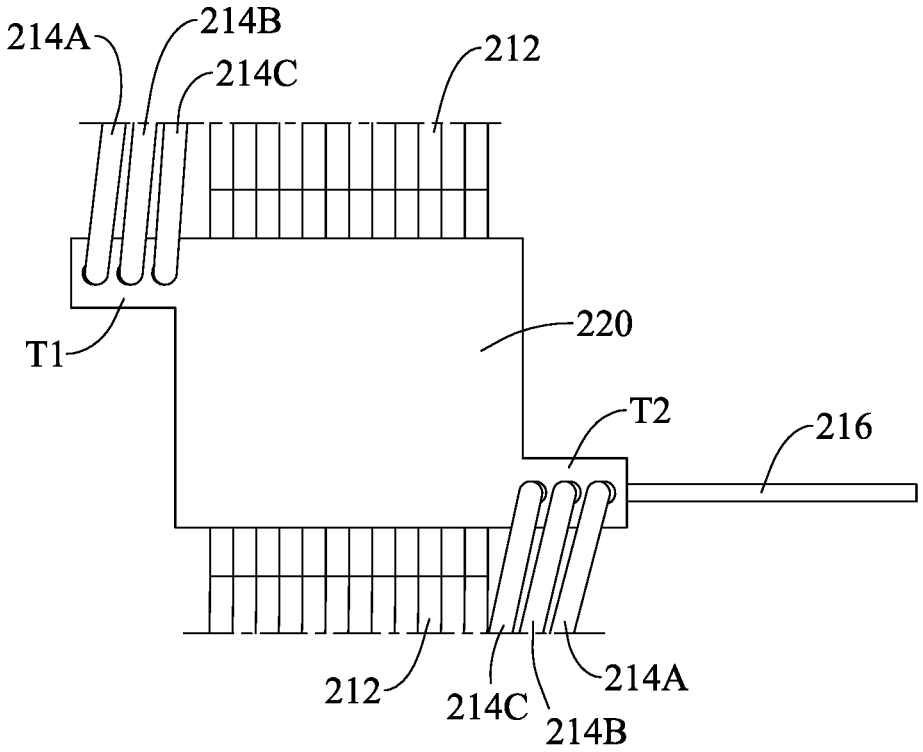
FIG. 3 is a schematic top view showing connections of the heat exchange chamber and the metal pipes of FIG. 2.
Figure 4:
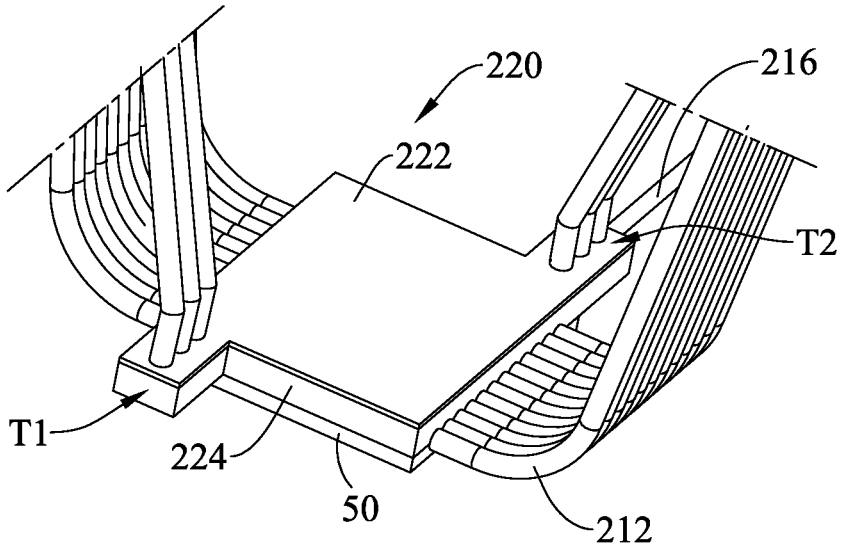
FIG. 4 is a schematic perspective view of FIG. 3.

Refer now to FIG. 2 through FIG. 4; where FIG. 2 is a schematic perspective of an exemplary embodiment of FIG. 1, FIG. 3 is a schematic top view showing connections of the heat exchange chamber and the metal pipes of FIG. 2, and FIG. 4 is a schematic perspective view of FIG. 3. As shown, the three dimensional pulsating heat pipe 200 is one of many exemplary embodiments in accordance with the three dimensional pulsating heat pipe 100 of FIG. 1. This three dimensional pulsating heat pipe 200 includes a three dimensional pipe coil structure 210 and a heat exchange chamber 220. The three dimensional pipe coil structure 210 is formed by continuously bending a pipe assembly of three metal pipes 212, 214 to surround a central axis C five times and by a horizontal offset for each circling of the metal pipes 212 along the central axis C, such that a three dimensional structure can be formed by arranging these three metal pipes 212, 214 in parallel to form three parallel circular loops able to perform corresponding pulsating functions. All these three metal pipes 212, 214 are connected to the common heat exchange chamber 220, with the metal pipes 212 to pass through the heat exchange chamber 220 at a lower portion thereof and the metal pipes 214 to directly connect the heat exchange chamber 220. Through the aforesaid three dimensional stacking manner, since the metal pipes 212, 214 of the three dimensional circular pipe structure 210 surround the central axis C in the same direction and stack closely in parallel to form a compact close-stacked heat contact surface, thus the aforesaid curvature limitation in manufacturing would be removed, and the manufacturing is much easier. In other words, the manufacturing of the embodiment of this disclosure does not require any specific bending fixture, and so the manufacturing cost can be reduced.

In this exemplary embodiment, the two opposite sides of the three dimensional pipe coil structure 210 are individually arranged as the condensation section A1 and the heating section A2, respectively. The condensation section A1 can include a heat sink 60, the heating section A2 can include a heat source 50, and the three dimensional circular pipe structure 210 includes two adiabatic sections A3, A4 disposed between the condensation section A1 and the heating section A2. In addition, the three dimensional pipe coil structure 210 of this exemplary embodiment is a symmetric structure. However, in some other embodiments, the three dimensional circular pipe structure 210 may be asymmetrically structured to meet specific requirements. In addition, the pipe diameter of any metal pipe 212, 214 can be ranging from 1.0 mm to 5.0 mm.

In this exemplary embodiment, the heat exchange chamber 220 is disposed at the heating section A2. Three pipes closely arranged in parallel have the end pipe portions 214A, 214B, 214C to connect a first end portion T1 of the heat exchange chamber 220, then these three metal pipes (i.e., the middle pipe portions 212) are bent together to surround the central axis C five times with each time to penetrate through the heat exchange chamber 220, and finally these three metal pipes extend another end pipe portions 214A, 214B, 214C to connect a second end portion T2 of the heat exchange chamber 220, such that the heat exchange chamber 220 and the three dimensional pipe coil structure 210 can be integrated to form a single close loop (common at the heat exchange chamber 220) for the working fluid to circulate in all these three metal pipes and to act as the heat-transfer medium inside the heat exchange chamber 220. Further, with three or more metal pipes to carry out the in-pipe flow, the corresponding flow resistance can be reduced. In one embodiment, the three dimensional pulsating heat pipe 200 can further include a filling pipe 216 connected with the second end portion T2 of the three dimensional circular pipe structure 210. Preferably, the working fluid is filled into the metal pipes 212, 214 by a 30-80% fill percentage.

Upon such an arrangement of this exemplary embodiment, at the lower portion of the three dimensional pipe coil structure 210, the metal pipes 212 penetrate through the heat exchange chamber 220 by passing a top of the heat source 50 (the lower portion of the heat exchange chamber 220). On the other hand, the other metal pipes 214 of the three dimensional circular pipe structure 210 are connected to the heat exchange chamber 220 from a top portion of the heat exchange chamber 220, as shown in FIG. 5. In addition, by providing the heat exchange chamber 220 to contain also the same working fluid, more working fluid per unit time can be utilized as a medium for heat transfer, and thus two evaporation patterns of the working fluid can be established for enhancing the heat transfer and heat exchange capacity per unit area of the entire three dimensional pulsating heat pipe 200. For example, as shown in FIG. 5, the working fluid can flow through the metal pipe 212 that penetrates through the heat exchange chamber 220 via the inflow direction L2 and/or the outflow direction L1 (it depends on a steady state circulating the working fluid). The working fluid inside the metal pipe 212 would be heated up to evaporate while passing through the heat exchange chamber 220 where a copper sleeve tightly wrapping the metal pipe 212 can be applied to help the heat to be conveyed into the metal pipe 212, and such a heat exchange pattern upon the working fluid inside the metal pipe 212 is defined as the first evaporation of this disclosure. The heat transferred from the heat source 50 or another foreign heat source (located below the heat exchange chamber 220 in FIG. 5) into the heat exchange chamber 220, i.e., along a heat conduction path P1 (may be enforced by a copper interface with a specific thickness), would evaporate the working fluid thereinside. Besides, the working fluid flowing inside the three dimensional circular pipe structure 210 would finally flow into the heat exchange chamber 220 via the metal pipes 214. In this disclosure, evaporation of the working fluid inside the heat exchange chamber 220 is defined as the second evaporation of this disclosure. In addition, the direction to flow the working fluid in the metal pipe 214 can be either the outflow direction L3 or the inflow direction L4, depending on the steady-state operation of this heat pipe 200. With the first and second evaporation, the working fluid flowing in the three dimensional pulsating heat pipe 200 can absorb more heat to enhance the heat transfer and heat exchange capacity per unit area.

It shall be explained that this disclosure does not limit the type of the heat exchange chamber 220. For example, as shown in FIG. 4, the heat exchange chamber 220 includes the heat source 50, an accommodation container 224 located above the heat source 50, and a cover 22, where the accommodation container 224 has the first end portion T1 and the second end portion T2. The cover 222 is used for covering the accommodation container 224. In addition, the heat exchange chamber 220 can further include another heat transfer structure (not shown in the figure), such as a copper member to sleeve the metal pipe 212 or to interface the heat transfer chamber 220 and the foreign heat source. Namely, except for the aforesaid heat exchange chamber 220 to increase the heat flux, the heat transfer structure can be applied to further increase the heat flux. In addition, inside the accommodation container 224, a plurality of heat transfer-enhancing structures can be furnished. Some examples of the heat transfer-enhancing structures can be seen in FIG. 6 to FIG. 8.

Figure 6:
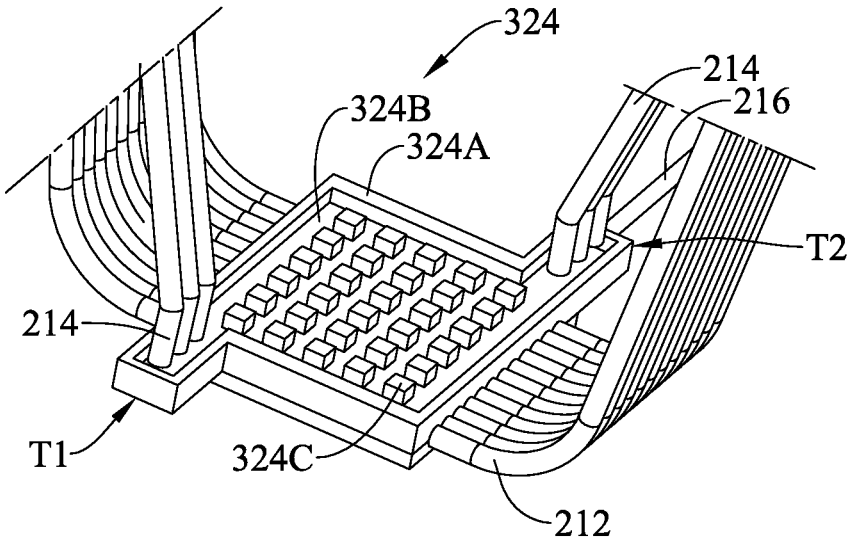
FIG. 6 is a schematic perspective view demonstrating an embodiment of the heat transfer-enhancing structures inside the accommodation container of FIG. 2.

Referring to FIG. 6, a schematic perspective view demonstrating an embodiment of the heat transfer-enhancing structure inside the accommodation container of FIG. 2 is provided. In FIG. 6, it shall be explained that the cover of the heat exchange chamber 220 is removed for clearly illustrating the heat transfer-enhancing structure inside the accommodation container 324. In this embodiment, the accommodation container 324 includes a side wall 324A and a bottom wall 324B connected with the side wall 324A to define an accommodation space thereinside. The heat transfer-enhancing structure is a protrusive stub 324C protruding out from the bottom wall 324B of the accommodation container 324. These protrusive stubs 324C are all arranged within the side wall 324A of the accommodation container 324 and between the first end portion T1 and the second end portion T2, and the same spacing is used to separate the two neighboring protrusive stubs 324C. By having FIG. 6 as an example, these protrusive stubs 324C present a regular arrangement, and keep the same interval. With the addition of these protrusive stubs 324C inside the accommodation container 324, these protrusive stubs 324C can further provide more heat exchange areas. In some other embodiments, these protrusive stubs 324C may have non-identical intervals.

Figure 7:
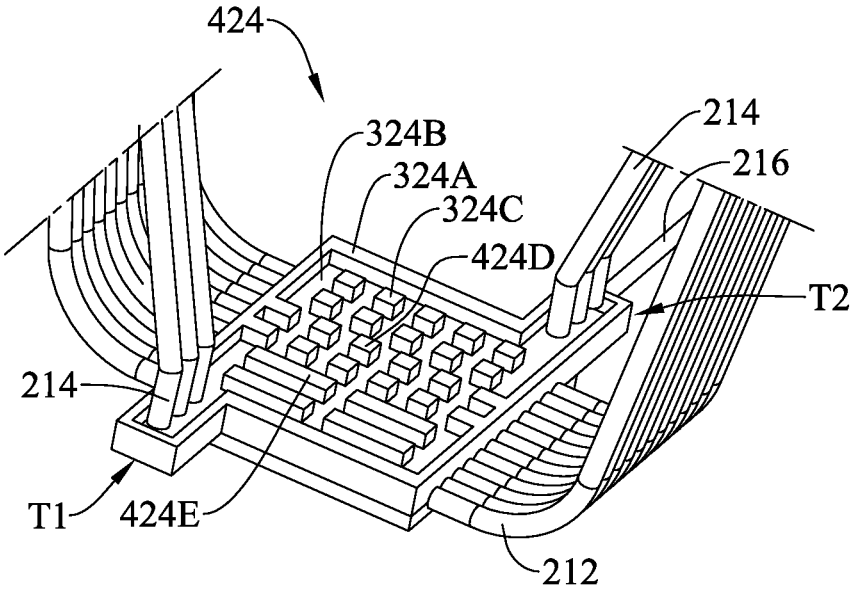
FIG. 7 is a schematic perspective view demonstrating another embodiment of the heat transfer-enhancing structures inside the accommodation container of FIG. 2.

Referring to FIG. 7, a schematic perspective view demonstrating another embodiment of the heat transfer-enhancing structure inside the accommodation container of FIG. 2 is provided. In FIG. 7, it shall be explained that the cover of the heat exchange chamber 220 is removed for clearly illustrating the heat transfer-enhancing structure inside the accommodation container 424. In this embodiment, the difference between the heat transfer-enhancing structure of the accommodation container 424 and that of the accommodation container 324 in FIG. 6 at least includes that, beside the protrusive stubs 324C, the heat transfer-enhancing structure further includes protrusive stubs 424D and protrusive stubs 424E. As shown, the protrusive stubs 324C and the protrusive stubs 424D are arranged in a staggered manner, such that a pressure difference is generated to flow the working fluid. In addition, the protrusive stub 324C and the protrusive stub 424D have the same length, but this length is smaller than that of the protrusive stub 424E. By having FIG. 7 as an example, the length of the protrusive stub 424E close to the first end portion T1 is different to that of the protrusive stub 324C close to the second end portion T2, the protrusive stub 424E is formed as a lying rectangular column, and the protrusive stub 324C is formed as a square stub. Of course, all the aforesaid parameters or dimensions can be adjusted according to practical requirements. For example, the interval of these protrusive stubs close to the first end portion is different to that of these protrusive stubs close to the second end portion. By adjusting the arrangement or the length, the pressure difference induced from the width for flowing the working fluid can be controlled, the anti-gravity performance can be promoted, and also the working fluid would generate non-uniform flow resistance. The working fluid of this disclosure flows unidirectional, such that, even in a horizontal position or in a negative angle (i.e., the state that the heat source is higher than the heat sink, as shown in FIG. 9), the three dimensional pulsating heat pipe can be continuously operated to transfer the heat, and further to dissipate the heat from a target heat source.

Figure 8:
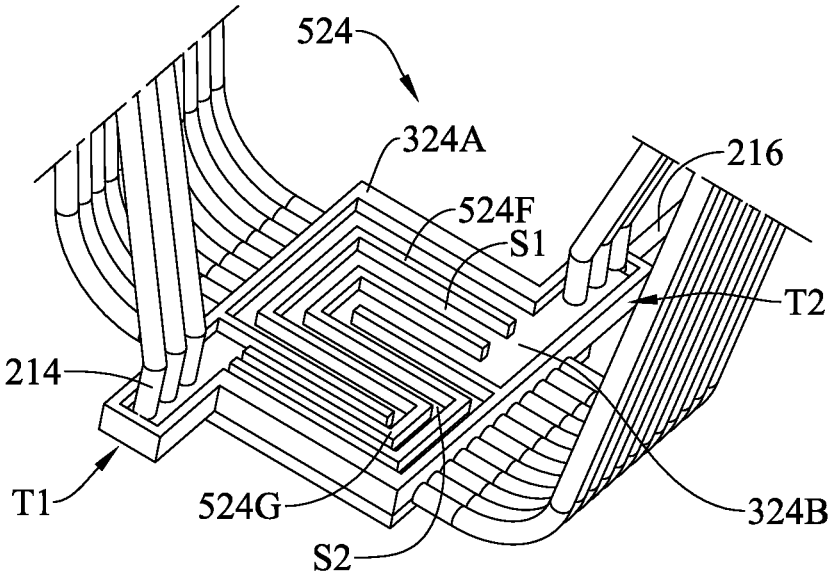
FIG. 8 is a schematic perspective view demonstrating a further embodiment of the heat transfer-enhancing structures inside the accommodation container of FIG. 2.

In this disclosure, the type of the heat transfer-enhancing structure is not limited any specific pattern. Referring to FIG. 8, a schematic perspective view demonstrating a further embodiment of the heat transfer-enhancing structure inside the accommodation container of FIG. 2 is provided. In FIG. 8, it shall be explained that the cover of the heat exchange chamber 220 is removed for clearly illustrating the heat transfer-enhancing structure inside the accommodation container 524. In this embodiment, the heat transfer-enhancing structure includes protrusive ribs 524F, 524G protruding from the bottom wall 324B of the accommodation container 524. These protrusive ribs 524F close to the second end portion T2 have different extension lengths, these protrusive ribs 524F are formed into corresponding winding shapes, and channels S1 are formed to every two neighboring winding shapes. Similarly, another channels S2 are formed to every two neighboring protrusive ribs 524G close to the second end portion T2. As such, beside that the protrusive ribs 524F, 524G can further provide more heat exchange areas, the channel S1 and the channel S2 have different widths to produce a specific pressure difference for flowing the working fluid in the accommodation container 524. Also, the working fluid can flow under non-uniform flow resistance, and thus the three dimensional pulsating heat pipe can be operated horizontally or in a negative angle (i.e., the state that the heat source is higher than the heat sink, as shown in FIG. 9).

Figure 9:
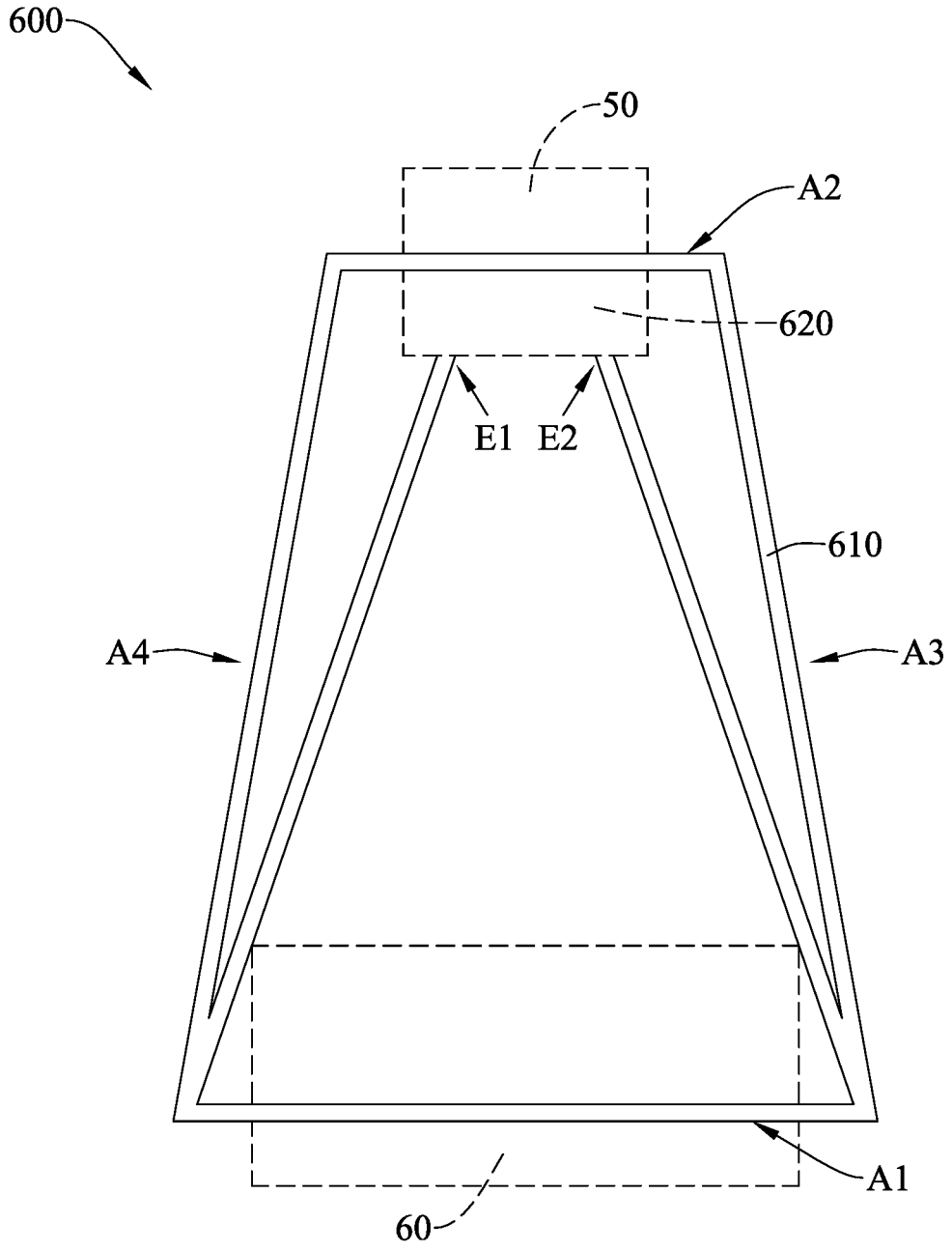
FIG. 9 is a schematic view of another embodiment of the three dimensional pulsating heat pipe in accordance with this disclosure.

Referring to FIG. 9, a schematic view of another embodiment of the three dimensional pulsating heat pipe in accordance with this disclosure is shown. In this embodiment, the difference between the three dimensional pulsating heat pipe 600 and that 100 of FIG. 1 includes at least that the three dimensional pulsating heat pipe 600 is posed in a negative angle, i.e., include the heat source located at an upper portion of the three dimensional pulsating heat pipe 600. That is, the heating section A2 connecting the heat source 50 is located on top of the three dimensional pipe coil structure 610, and the heat exchange chamber 620 at the heating section A2 are to connect the first ends E1 and the second ends E2 of the metal pipe. The heat sink 60 is connected to the condensation section A2 located at a lower portion of the three dimensional pipe coil structure 620. In this embodiment, the three dimensional pipe coil structure 620 can be resembled to the three dimensional pipe coil structure 220 of FIG. 2, and the heat exchange chamber 620 can apply any heat exchange chamber of FIG. 2 through FIG. 8.

Figure 10:
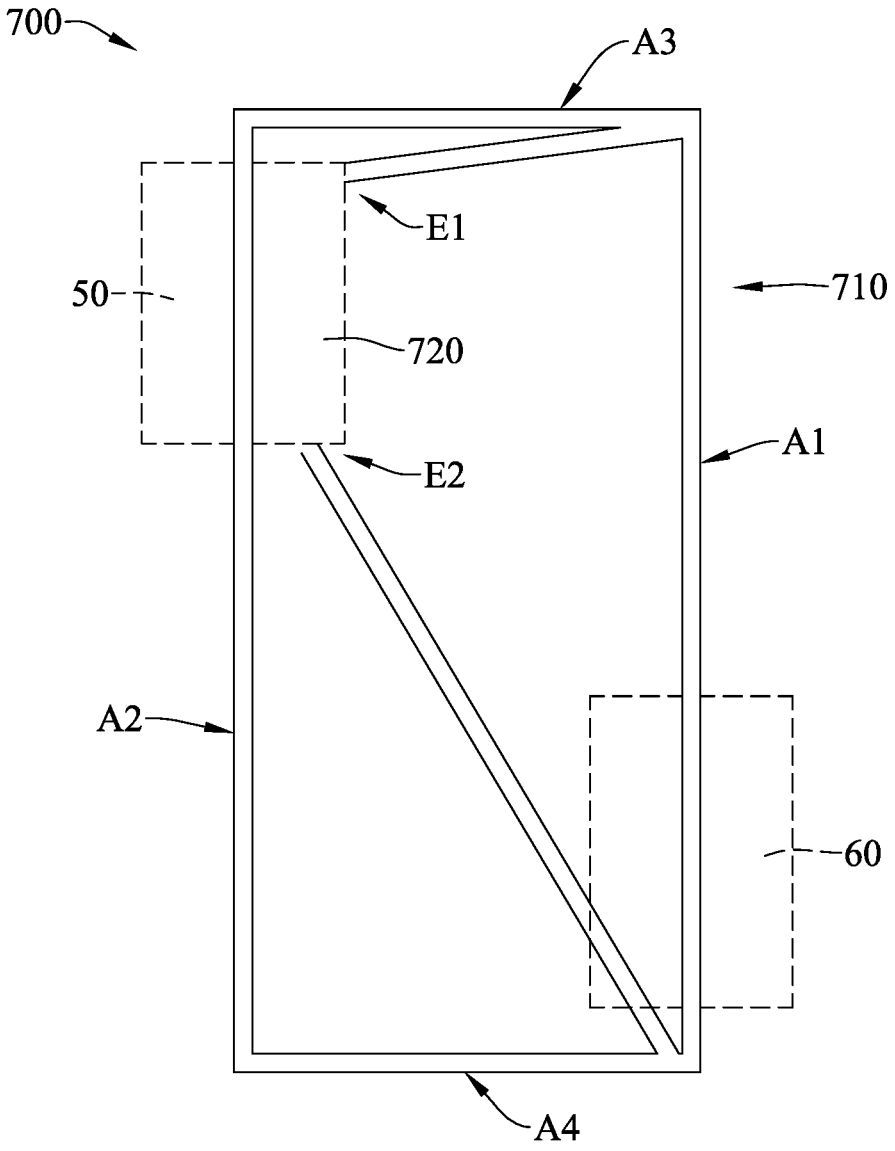
FIG. 10 is a schematic view of a further embodiment of the three dimensional pulsating heat pipe in accordance with this disclosure.

Referring now to FIG. 10, a schematic view of a further embodiment of the three dimensional pulsating heat pipe in accordance with this disclosure is shown. The difference between the three dimensional pulsating heat pipe 700 of FIG. 10 and that 100 of FIG. 1 includes at least that the three dimensional pulsating heat pipe 700 of this embodiment is laterally heated. By having FIG. 10 as example, the heating section A1 and the condensation section A2 of the three dimensional pulsating heat pipe 700 are disposed to two opposite long lateral sides of the three dimensional pipe coil structure 710. That is, the heating section A1 connecting the heat source 50 is located at one lateral side of the three dimensional pipe coil structure 710, while the condensation section A2 mounting the heat sink 60 is located at another side thereof. Also, the heating section A1 and the condensation section A2 are diagonally disposed at the three dimensional pipe coil structure 710. The heat exchange chamber 720, disposed in the heating section A2 of the three dimensional pipe coil structure 710, connects all the first ends E1 and the second ends E2 of the three dimensional pipe coil structure 710. In addition, the three dimensional pipe coil structure 720 of this embodiment can adopt an arrangement pattern resembled to that of the three dimensional pipe coil structure 220 *i* FIG. 2, and the heat exchange chamber 720 can apply any heat exchange chamber from FIG. 2 to FIG. 8.

Figure 11:
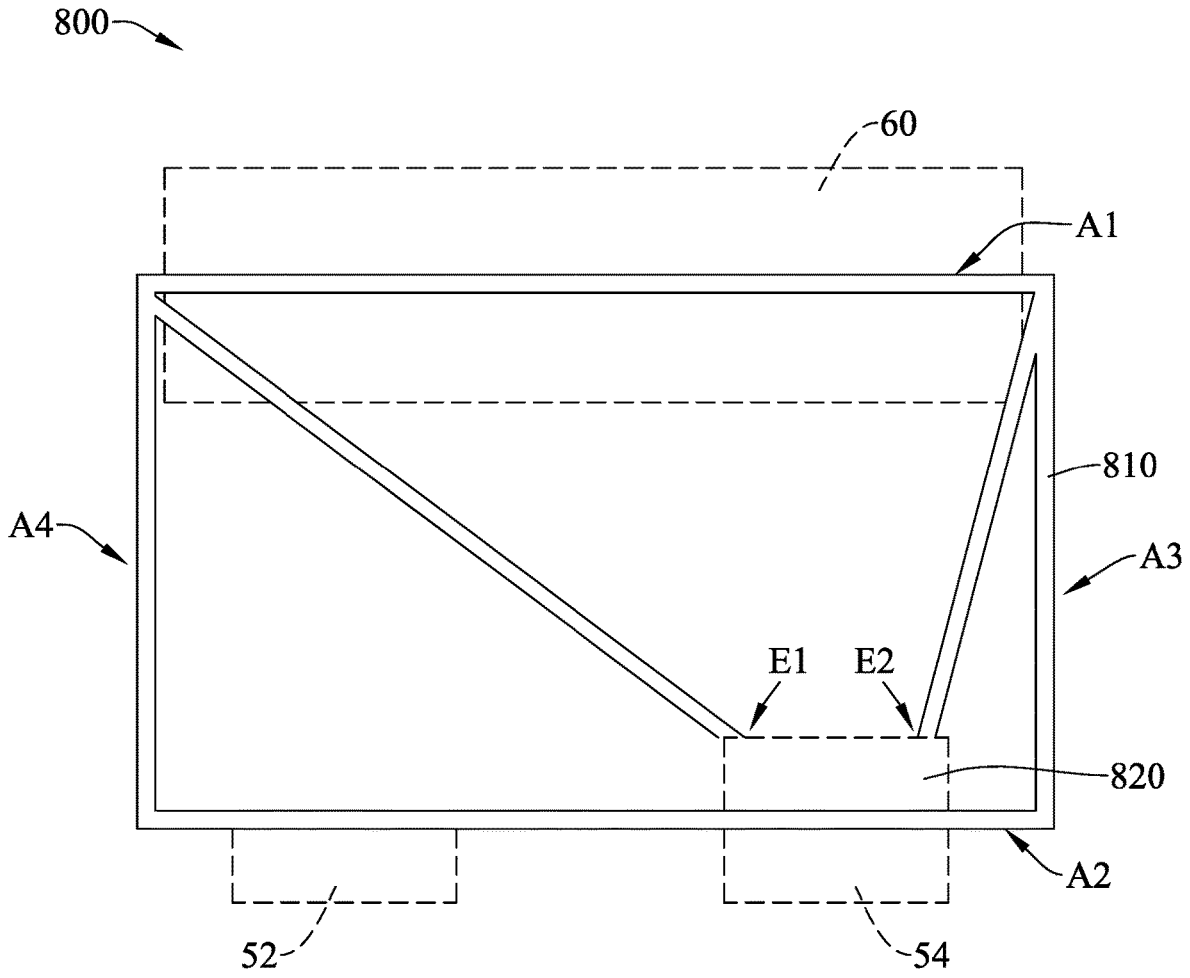
FIG. 11 is a schematic view of one more embodiment of the three dimensional pulsating heat pipe in accordance with this disclosure.

Referring to FIG. 11, a schematic view of one more embodiment of the three dimensional pulsating heat pipe in accordance with this disclosure is shown. The difference between the three dimensional pulsating heat pipe 800 of FIG. 11 and that 100 of FIG. 1 includes at least that the three dimensional pulsating heat pipe 800 of this embodiment is applied simultaneously to a plurality of heat sources (two 52, 54 shown in the figure). By having FIG. 11 for an example, the heat exchange chamber 820 is connected with the first ends E1 and the second ends E2 of the corresponding metal pipes of the three dimensional pipe coil structure 810, and disposed close to one of these heat sources (54 in the drawing). The arrangement of the three dimensional pipe coil structure 820 in this embodiment can adopt that of the three dimensional pipe coil structure 220 in FIG. 2, and the heat exchange chamber 820 of this embodiment can apply any heat exchange chamber from FIG. 2 to FIG. 8. Of course, in some other embodiments, the heat source 52 can be further furnished with another heat exchange chamber.

Figure 12:
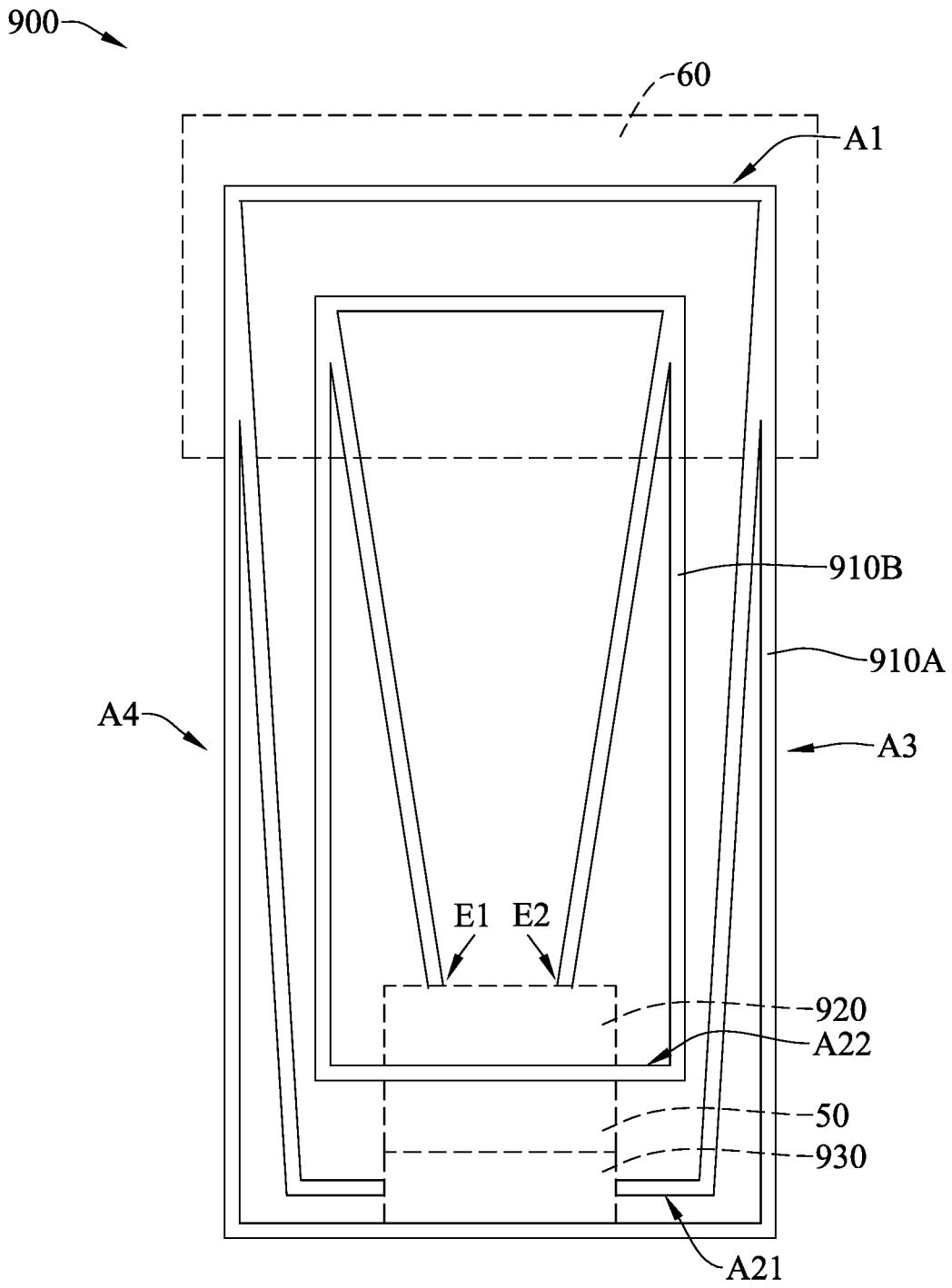
FIG. 12 is a schematic view of one more further embodiment of the three dimensional pulsating heat pipe in accordance with this disclosure.

Referring to FIG. 12, a schematic view of one more further embodiment of the three dimensional pulsating heat pipe in accordance with this disclosure is shown. The difference between the three dimensional pulsating heat pipe 900 of FIG. 12 and that 100 of FIG. 1 includes at least that the three dimensional pulsating heat pipe 900 of this embodiment is a dual-module type having two three dimensional pipe coil structures 910A, 910B equipped individually with two heat exchange chambers 930, 920, respectively. Any of the two three dimensional pipe coil structures 910A, 910B can adopt the arrangement pattern applied to the three dimensional pipe coil structure 220 of FIG. 2, and any of the two heat exchange chambers 920, 930 can adopt any heat exchange chamber from FIG. 2 to FIG. 8. The heat exchange chamber 930 is mounted to the heating section A21 of the three dimensional circular pipe structure 910A, and the heat exchange chamber 920 is mounted to the heating section A22 of the three dimensional pipe coil structure 910B. Thereupon, the two heat exchange chambers 920, 930 are provided to the top and the bottom of the heat source 50, respectively, such that the entire heat transfer capacity can be further increased.

In summary, in the three dimensional pulsating heat pipe provided in this disclosure, the heat section of the three dimensional pipe coil structure is contacted with the heat exchange chamber, and the heat exchange chamber is further connected with the opposing ends of the metal pipes forming the three dimensional pipe coil structure, such that the heat exchange chamber and the three dimensional pipe coil structure are integrated to form a single close loop. In comparison with the conventional design who provides only the heating section of the metal pipes to form the heat exchange area, the heat exchange chamber of this disclosure can provide more working fluid to be heated at the heating section. Namely, though the heating area of the heating section might be the same, yet the three dimensional pulsating heat pipe furnished with the heat exchange chamber according to this disclosure can be superior in providing the entire heat transfer and heat exchange capacity per unit area.

Further, by having the heat transfer-enhancing structure furnished into the heat exchange chamber according to this disclosure, the heat flux can be further increased.

In addition, by adjusting the arrangement, the shapes and the widths of the heat transfer-enhancing structure of this disclosure, the pressure difference between the fluid inlet and outlet can be controlled, the anti-gravity performance can be increased, and thus non-uniform flow resistance upon the working fluid would be induced, such that the three dimensional pulsating heat pipe can be continuously operated at a normal horizontal position or a negative-angle position to provide heat transfer from the heat source to a dissipation end.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A three dimensional pulsating heat pipe, comprising:

a three dimensional pipe coil structure, formed by winding a plurality of metal pipes to surround repeatedly a central axis and stack by extending along the central axis, two opposite sides of the three dimensional circular pipe coil structure being located inside of a heating section structure and a condensation section structure, respectively;

a heat exchange chamber, disposed in the heating section structure, two opposite ends of each of the plurality of metal pipes being connected with an interior of the heat exchange chamber such that the interior of the heat exchange chamber is fluidically connected with an interior of each of the metal pipes via the two opposite ends; and a plurality of heat transfer-enhancing structures protruding into the interior of the heat exchange chamber.

2. The three dimensional pulsating heat pipe of claim 1, wherein the heat exchange chamber includes a cover and an accommodation container, the accommodation container has a first end portion and a second end portion, each of the plurality of heat transfer-enhancing structures protruding from the accommodation container, and the cover is used for covering, the accommodation container.

3. The three dimensional pulsating heat pipe of claim 2, wherein each of the plurality of heat transfer-enhancing structures is a protrusive stub, and the plurality of protrusive stubs are particularly arranged inside the accommodation container.

4. The three dimensional pulsating heat pipe of claim 3, wherein an interval of the protrusive stubs close to the first end portion is different to another interval of the protrusive stubs close to the second end portion.

5. The three dimensional pulsating heat pipe of claim 3, wherein a length of the protrusive stubs close to the first end portion is different to another length of the protrusive stubs close to the second end portion.

6. The three dimensional pulsating heat pipe of claim 3, wherein the plurality of protrusive stubs are spaced by the same interval.

7. The three dimensional pulsating heat pipe of claim 3, wherein the plurality of protrusive stubs have different length.

8. The three dimensional pulsating heat pipe of claim 2, wherein each of the plurality of heat transfer-enhancing structures is a protrusive rib, and the plurality of protrusive ribs are integrated to form at least a channel.

9. The three dimensional pulsating heat pipe of claim 8, wherein the protrusive ribs between the first end portion and the second end portion have different widths.

10. The three dimensional pulsating heat pipe of claim 8, wherein the protrusive ribs between the first end portion and the second end portion have the same width.

11. The three dimensional pulsating heat pipe of claim 1, further including a filling pipe connected with the three dimensional pipe coil structure.

12. The three dimensional pulsating heat pipe of claim 1, including two adiabatic sections between the heating section and the condensation section.

13. The three dimensional pulsating heat pipe of claim 1, wherein the three dimensional pipe coil structure is one of a symmetric structure and an asymmetric structure.

14. The three dimensional pulsating heat pipe of claim 1, wherein the at least one metal pipe has a pipe diameter ranging from 1 mm to 5 mm.

15. The three dimensional pulsating heat pipe of claim 1, wherein the three dimensional pipe coil structure is winded into a rectangular, trapezoidal or triangular form.

16. The three dimensional pulsating heat pipe of claim 1, wherein the heating section and the condensation section has the same length.

17. The three dimensional pulsating heat pipe of claim 1, wherein the heating section has a different length to the condensation section.

* * * * *